US011199053B2

(12) United States Patent
Johnson et al.

(10) Patent No.: US 11,199,053 B2
(45) Date of Patent: Dec. 14, 2021

(54) SUCKER ROD WITH ADHESIVE-ATTACHED END PIECE

(71) Applicant: TRC Services, Inc., The Woodlands, TX (US)

(72) Inventors: Donald Mike Johnson, The Woodlands, TX (US); Michael Eric Johnson, The Woodlands, TX (US); Donald Marvin Ewing, Midland, TX (US)

(73) Assignee: TRC Services, Inc., The Woodlands, TX (US)

( * ) Notice: Subject to any disclaimer, the term of this patent is extended or adjusted under 35 U.S.C. 154(b) by 0 days.

(21) Appl. No.: 16/748,248

(22) Filed: Jan. 21, 2020

(65) Prior Publication Data

US 2020/0232285 A1 Jul. 23, 2020

Related U.S. Application Data

(60) Provisional application No. 62/794,861, filed on Jan. 21, 2019.

(51) Int. Cl.
*E21B 17/00* (2006.01)
*E21B 19/00* (2006.01)
*E21B 43/12* (2006.01)

(52) U.S. Cl.
CPC ..... *E21B 17/00* (2013.01); *E21B 19/00* (2013.01); *E21B 43/126* (2013.01)

(58) Field of Classification Search
CPC ..... E21B 19/00; E21B 17/00; E21B 43/126
See application file for complete search history.

(56) References Cited

U.S. PATENT DOCUMENTS 2,874,937 A 2/1959 Higgins
3,489,445 A * 1/1970 Kammerer, Jr. ..... F04B 53/144 403/343
4,360,288 A 11/1982 Rutledge, Jr. et al.
4,475,839 A 10/1984 Strandberg
4,484,833 A 11/1984 Gallagher, Jr.
4,585,368 A * 4/1986 Pagan ..... E21B 17/00 166/68
4,597,688 A * 7/1986 Pagan ..... E21B 17/00 156/289
4,796,799 A 1/1989 Rasi-Zade et al.
(Continued)

OTHER PUBLICATIONS

R.A. Ryan (Exxon Co. USA), "Controlling Rod Body Corrosion Failures With Spray-Metal Plastic-Coated Sucker Rods," https://doi.org/10.2118/17299-MS, Doc ID SPE-17299-MS, Society of Petroleum Engineers, Permian Basin Oil and Gas Recovery Conference, Mar. 10-11, Midland, Texas, 1988, 2 pages.
(Continued)

*Primary Examiner* — Taras P Bemko
(74) *Attorney, Agent, or Firm* — Blank Rome LLP

(57) ABSTRACT

A metal sucker rod has a first end and a second end spaced apart from the first end. At least one end piece with a recess is configured to receive one of the first end and the second end of the metal sucker rod. The metal sucker rod includes an adhesive applied to at least one of a) the first end and the second end of the steel rod and b) in the recess of the at least one end piece. The adhesive is configured to secure the end piece to one of the first end and the second end.

20 Claims, 3 Drawing Sheets

(56) References Cited

U.S. PATENT DOCUMENTS

| | | | | |
|---|---|---|---|---|
| 5,253,946 | A | 10/1993 | Watkins | |
| 6,193,431 | B1 | 2/2001 | Rutledge | |
| 2013/0336711 | A1 | 12/2013 | Hale et al. | |
| 2016/0060969 | A1 | 3/2016 | Rutledge et al. | |
| 2016/0102504 | A1 | 4/2016 | Gernentz et al. | |
| 2016/0102694 | A1* | 4/2016 | Gernentz ..... | F16B 11/008<br>403/268 |

OTHER PUBLICATIONS

Norris Dover Artificial Lift, "Sucker Rod Failure Analysis," Brochure V4, Nov. 4, 2015, 24 pages.

* cited by examiner

SUCKER ROD WITH ADHESIVE-ATTACHED END PIECE

CROSS-REFERENCE TO RELATED APPLICATIONS

This is a non-provisional of U.S. Patent Application Ser. No. 62/794,861 filed 21 Jan. 2019, which is incorporated herein by reference in its entirety and to which priority is claimed.

TECHNICAL FIELD

The embodiments disclosed herein relate to metal rods, typically sucker rods, used in the pumping equipment for the extraction of fluids, typically oil and gas, from a wellbore.

BACKGROUND

A sucker rod is a rigid rod used in the oil industry to connect surface equipment to a reciprocating piston pump installed in an oil well. These rods are typically between 25 and 30 feet (7 to 9 meters) in length and are threaded at both ends.

For example, FIG. 1 shows a reciprocating pump system 10 used to produce fluid from a wellbore. A downhole pump 14 has a barrel 16 with a standing valve 24 located at the bottom. The standing valve 24 allows fluid to enter from the wellbore, but does not allow the fluid to leave. Inside the pump barrel 16, a plunger 20 has a traveling valve 22, which allows fluid to move from below the plunger 20 to the production tubing 18 above, but does not allow fluid to return from the tubing 18 to the pump barrel 16 below the plunger 20. A driving source (e.g., a pump jack or pumping unit 26) at the surface connects by a rod string 12 to the plunger 20 and moves the plunger 20 up and down cyclically in upstrokes and downstrokes to lift fluid to the surface.

As shown in FIG. 1, the rod string 12 is comprised of multiple sucker rods 30 connected end-to-end by couplings 40. The sucker rods 30 and the couplings 40 have standards for their design, manufacture, and assembly from the American Petroleum Institute (API).

A steel sucker rod 30 as shown in FIG. 2 typically includes a length of steel bar 32 having ends 34 that are upset and forged onto the rod 30. After forging, the rod 30 is heat treated, and thread rollers are utilized to thread pins 36 on the ends 34 of the rod 30. A connector 40 threaded to the pins 36 is used to connect the rods 50 end-to-end.

This manufacturing process of forging and heat treating, however, is susceptible to forging errors and the introduction of defects, such as micro-fractures, in the ends 34, particularly where the ends 34 join to the steel rod 32. Furthermore, after the forging process, the steel rod 30 must be heat treated in an effort to reduce residual stresses and other potential defects and/or stress concentrators that may be introduced into the steel rod 32 and/or the end 34 during the forging process. Heat treating adds both time and expense to the manufacture of sucker rods.

There exists a need, then, for a sucker rod that does not require heat treatment of forged ends and that is more robust than other manufacturing processes.

The subject matter of the present disclosure is directed to overcoming, or at least reducing the effects of, one or more of the problems set forth above.

SUMMARY

A sucker rod includes a metal rod having a first end and a second end 16 spaced apart from the first end. The sucker rod includes at least one end piece with a recess configured to receive one of the first end and the second end. The sucker rod optionally includes an adhesive applied to at least one of a) the first end and the second end of the metal rod and b) in the recess of the at least one end piece. The adhesive is configured to secure the end piece to one of the first end and the second end of the metal rod.

Optionally, the adhesive is configured to be set by at least one of a) a curing agent appropriate for the specific adhesive, b) setting, e.g., leaving the adhesive undisturbed, for a period of time, c) applying heat through the use of a heat soak, heat lamps, heat guns, and other sources of heat, and d) applying pressure, whether circumferentially, or through a force that applies compression or tension. The adhesive optionally includes any type of adhesive. In some embodiments, the adhesive comprises one of a) a two-part epoxy resin and b) a one-part epoxy resin. The various epoxy resins may be of any type suitable, particularly those suitable for use in a wellbore, combining metal-to-metal, exposure to hydrocarbons and/or water, exposure to temperatures up to 500° F. (260° C.), and pressures up to 20,000 pounds per square inch (138 MPa).

Optionally, the recess and/or the first end and/or the second end may include an engagement feature. The engagement feature is configured to couple or lock the recess with one of the first end and the second end of the metal rod.

Optionally, the sucker rod includes an axial gap between an end of the end piece and a body of the metal rod. The axial gap optionally may be filled with a material configured to resist compression positioned at least partially within the axial gap.

Methods of manufacturing a sucker rod are also disclosed. The method includes obtaining a length of metal rod having a first end and a second end spaced apart from the first end. The method also includes obtaining at least one end piece with a recess configured to receive one of the first end and the second end. The method further includes applying an adhesive to at least one of a) the first end and the second end of the steel rod and b) in the recess of the at least one end piece and setting the adhesive.

The foregoing has outlined rather broadly the features of the present disclosure in order that the detailed description that follows may be better understood. Additional features and advantages of the disclosure will be described hereinafter, which form the subject of the claims.

The foregoing summary is not intended to summarize each potential embodiment or every aspect of the present disclosure.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

The drawings are not necessarily to scale.

DETAILED DESCRIPTION

Figure 1:
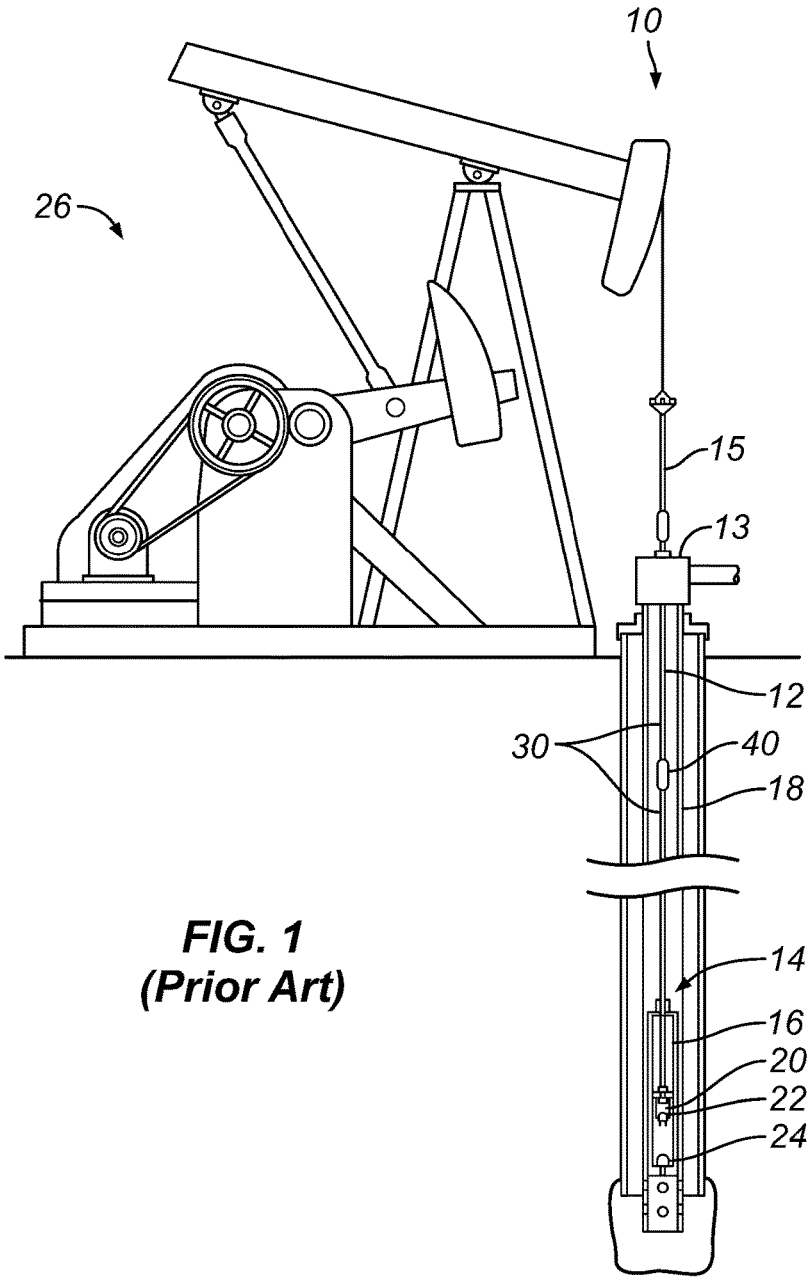
FIG. 1 (Prior Art)
FIG. 1 illustrates a reciprocating rod pump system according to the prior art.
Figure 2:
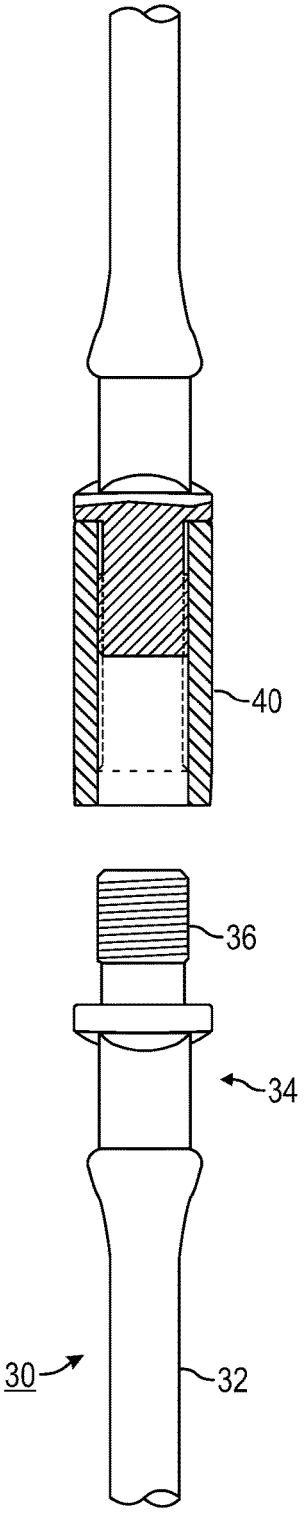
FIG. 2 (Prior Art)
FIG. 2 is an elevational view of forged sucker rod ends for coupling together with a connector.
Figure 3:
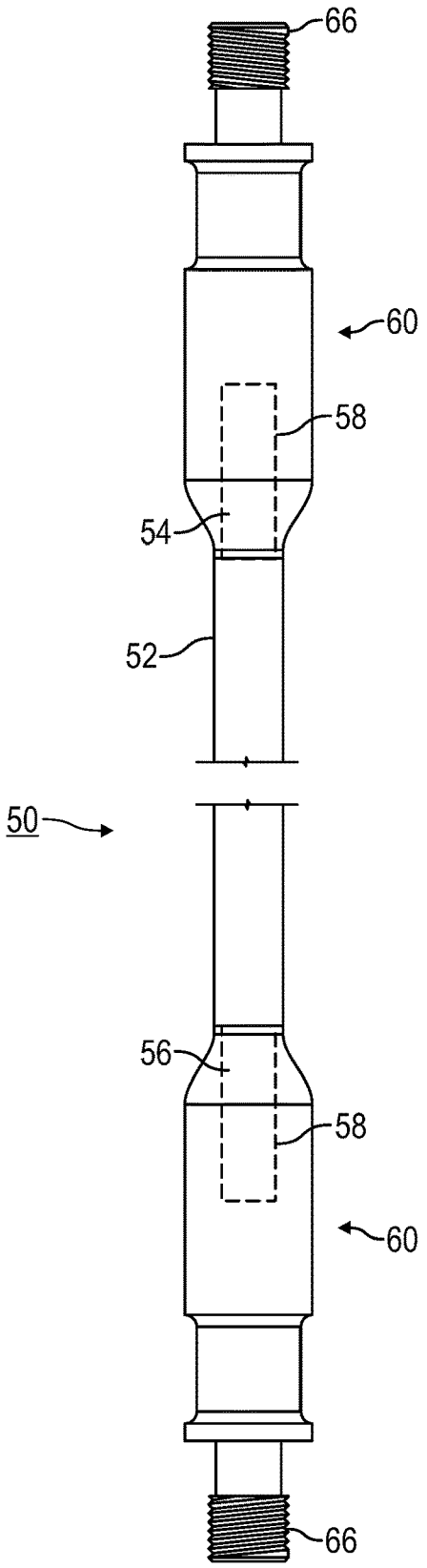
FIG. 3 is an elevational view of a sucker rod with adhesive-attached end pieces.
Figure 4:
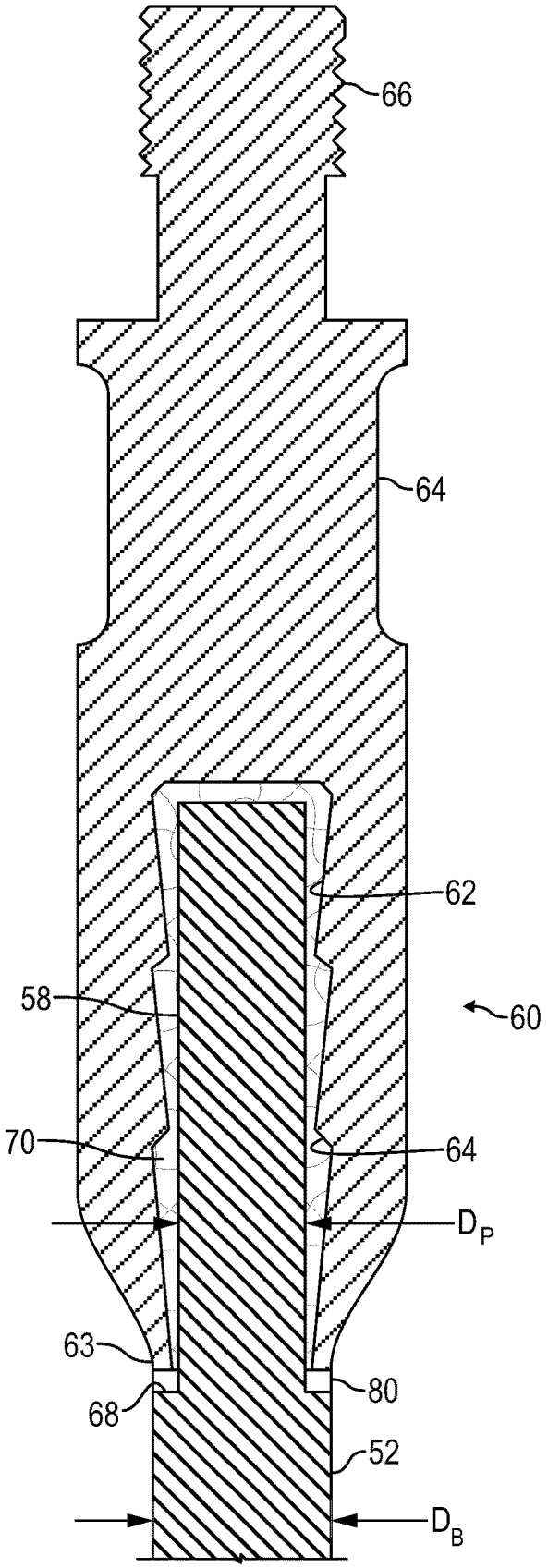
FIG. 4 is cross-sectional view of a portion of the sucker rod and the adhesive-attached end piece of FIG. 3.

FIG. 3 illustrates an elevational view of a sucker rod 50 according to the present disclosure, and FIG. 4 shows one end of the sucker rod 50 in cross-section. In general, the term "rod" can include hollow or solid rods, continuous rods or joints, and can includes welded, flanged, screwed, and other rod goods. In particular, sucker rod joints are one type of rod that can benefit from the methods described herein, but the disclosure is not so limited.

The sucker rod 50 includes a metal rod body 52 having a first end 54 and having a second end 56 spaced apart from the first end 54. At least one of the ends 54, 56 includes a pin or head 58 having a pin diameter DP smaller than a body diameter DB of the rod body 52.

The metal of the sucker rod 50 may be any type of metal, such as aluminum, steel, and any compositions of those metals. Aluminum and steel, as used herein, encompasses any composition that includes those base metals of aluminum and iron with any selected additional elements as desired.

The sucker rod 50 includes at least one end piece 60 having a recess 62 configured to receive the pin head 58 of the rod body 52. A reverse arrangement is also possible. The other end of the rod 50 may also include a pin head 58 having an end piece 60, such as shown in FIG. 3, affixed thereon.

The end piece 60 may include a threaded box or pin connection 66, such as an API standard connection. The end piece 60 may also optionally include wrench flats 64 configured to receive a wrench or other similar tool to tighten the connection between the sucker rod 50 and an adjacent sucker rod.

To affix the end piece 60 to the end 54, 56, an adhesive 70 is applied to at least one of a) the end 54, 56 of the metal rod body 52, which may include application of the adhesive to the head 58, and b) the recess 62 of the end piece 60. The adhesive 70 is configured to secure the end piece 60 to the end 54, 56 of the metal rod body 52.

The adhesive 70 is configured to be set by at least one of a) a curing agent appropriate for the specific adhesive, b) setting, e.g., leaving the adhesive undisturbed, for a period of time, c) applying heat through the use of a heat soak, heat lamps, heat guns, and other sources of heat, and d) applying pressure, whether circumferentially, or through a force that applies compression or tension.

In general, the adhesive 70 can include any type of adhesive suitable for affixing metal-to-metal. In some embodiments, the adhesive 70 comprises one of a) a two-part epoxy resin and b) a one-part epoxy resin. The various epoxy resins may be of any type suitable, particularly those suitable for use in a wellbore, combining metal-to-metal, exposure to hydrocarbons and/or water, exposure to temperatures up to 500° F. (260° C.), and pressures up to 20,000 pounds per square inch (138 MPa).

Additional affixing can be used between the end piece 60 and the end 54, 56. For example, the recess 62 and/or the head 58 can include an engagement feature 64. The engagement feature 64 is configured to couple or lock the recess 62 with the head 58 of the metal rod body 52. The engagement feature 64 can include at least one of a) threads, b) teeth, c) ridges, d) grooves, and e) at least one 3-dimensional shape, such as castellations, cylinders, rectangles, pyramids, squares, scales, and the like configured to engage with the recess 62 and/or the head 58 and/or the first end 54 and the second end 56. The engagement feature 64 may interact with a complementary engagement feature positioned in the recess 62 and the head 58, respectively, such as in the case of threads. Alternatively, the engagement feature 64 may elastically or plastically engage a surface of the recess 58 and the head 58.

Additional affixing can involve filling an axial gap 68 between an end 63 of the end piece 60 and the metal rod body 52 with a material 80 configured to resist compression. As shown, the axial gap 68 is formed between a shoulder on the lower end 63 of the end piece 60 and a shoulder on the rod body 52 at the pin head 58. The material 80 positioned at least partially within the gap 68 may be configured to be set by at least one of a) a curing agent appropriate for the specific adhesive, b) setting, e.g., leaving the adhesive undisturbed, for a period of time, c) applying heat through the use of a heat soak, heat lamps, heat guns, and other sources of heat, and d) applying pressure, whether circumferentially, or through a force that applies compression or tension. The material 80 can include any type of adhesive. In some embodiments, the material 80 can include one of a) a two-part epoxy resin and b) a one-part epoxy resin. The various epoxy resins may be of any type suitable, particularly those suitable for use in a wellbore, combining metal-to-metal, exposure to hydrocarbons and/or water, exposure to temperatures up to 500° F. (260° C.), and pressures up to 20,000 pounds per square inch (138 MPa).

Figure 5:
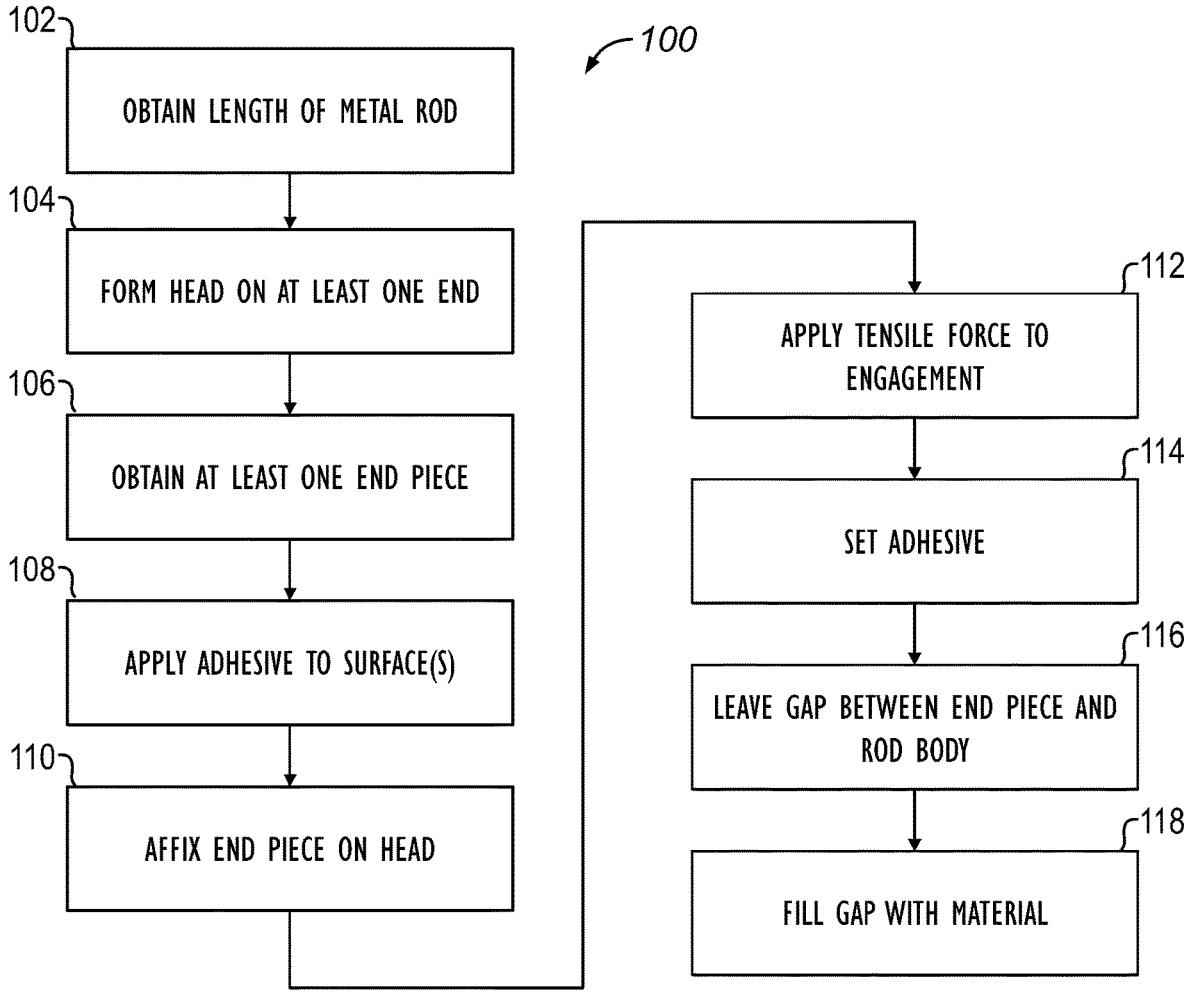
FIG. 5 shows a method of manufacturing a sucker rod according to the present disclosure.

FIG. 5 illustrates a method 100 of manufacturing a sucker rod 50 according to the present disclosure. The method 100 includes obtaining a length of metal rod body 52 having a first end 54 and a second end 56 spaced apart from the first end 52 (Block 102) and includes forming a pin head 58 on at least one end 54, 56 (Block 104). As noted above, the head 58 has a diameter DP less than the diameter DB of the rod body 52. Therefore, the head 58 can be formed by machining the end 54, 56 of the rod body 52 to the appropriate diameter. Moreover, should the head 58 have engagement features 64, they too can be machined on the head 58.

The method 100 also includes obtaining at least one end piece 60 with a recess 62 configured to receive one of ends 54, 56 (Block 106). As noted above, the end piece 60 is a separately formed component from the rod 50 and can be machined from stock material. In general, the material used for the end piece 60 may be the same or different from the material used for the rod 50. The end piece 60 is manufactured with the recess 62 (and any internal engagement feature 64) and with the pin end 66, flats 64, etc.

The method 100 further includes applying an adhesive 70 to surface(s), including those of at least one of a) the end 54, 56 (i.e., the head 58) of the steel rod 52 and b) in the recess 62 of the at least one end piece 60 (Block 108).

To affix the end piece 60 on the rod body 52 (Block 110), the head 58 is inserted into the recess 62 of the end piece 60 for the metal-to-metal adhesion), and the adhesive 70 is set (Block 114). Setting the adhesive 70 can include at least one of a) applying a curing agent, b) allowing the adhesive to set for a period of time, c) applying heat, and d) applying pressure.

When affixing the end piece 60 on the rod body 52 (Block 110), the method may further include applying a tensile force to at least one of the end piece 60 and the metal rod body 52 (Block 112). Applying the tensile force may aid in setting or locking the engagement feature 64 in the recess 62 of the end piece 60 or on the head 58 to one of the end 54, 56 of the metal rod body 52 and a surface of the recess 62, respectively. To apply the tensile force, the rod body 52 is held at one end, while the pin end 56, flats 54, or other surface of the end piece 60 are held at the other. Displacement between the two can put the connection therebetween, namely the engagement features 64 of the head 58 in tension, while the adhesive sets.

The application of the tensile force may produce a gap 68, and/or the gap 68 may be preconfigured in the machining of the end piece 60 and the head 58 of the rod body 52. Either way, the method 100 may include leaving a gap 68 between an end 63 of the end piece 60 and a body 52 of the metal rod body 52. Optionally then, the method 100 includes placing a material 80 configured to resist compression at least partially within the gap 68. As noted, this material 80 can include an adhesive, and the material 80 can be the same as or different from the adhesive used for the recess 62 and head 58.

One example of the process for remanufacturing or processing sucker rods is disclosed in U.S. Pat. No. 10,195,699, the disclosure of which is incorporated in its entirety by this reference.

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. All such similar substitutes and modifications apparent to those skilled in the art are deemed to be within the spirit, scope and concept of the disclosure as defined by the appended claims.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of manufacturing a sucker rod, the method comprising:

obtaining a length of metal rod having opposing ends;

obtaining at least one end piece defining a recess configured to receive at least one of the opposing ends, wherein the at least one opposing end comprises a head having a first diameter smaller than a second diameter of the metal rod, wherein the head is configured to be received within the recess of the at least one end piece;

applying an adhesive to at least one of a) the at least one opposing end and b) the recess of the at least one end piece;

affixing the at least one opposing end in the recess of the at least one end piece by setting the adhesive therebetween; and filling a gap, defined between a proximal end of the at least one end piece and a portion of the metal rod adjacent the proximal end, with a material configured to resist compression.

2. The method of claim 1, wherein setting the adhesive comprises at least one of a) applying a curing agent to the adhesive, b) allowing the adhesive to set for a period of time, c) applying heat to the adhesive, and d) applying pressure to the adhesive.

3. The method of claim 1, wherein the adhesive comprises one of a) a two-part epoxy resin and b) a one-part epoxy resin.

4. The method of claim 1, wherein affixing the at least one opposing end in the recess of the at least one end piece comprises applying a tensile force to at least one of the at least one end piece and the metal rod.

5. The method of claim 4, wherein affixing the at least one opposing end in the recess of the at least one end piece comprises setting an engagement feature in the recess of the at least one end piece to the at least one opposing end of the metal rod.

6. The method of claim 5, wherein applying the tensile force comprises creating the gap between the proximal end and the portion of the metal rod at least partially with the applied tensile force.

7. The method of claim 1, wherein affixing the at least one opposing end in the recess of the at least one end piece comprises locking an engagement feature in the recess of the at least one end piece to the at least one opposing end of the metal rod.

8. The method of claim 1, wherein the metal rod comprises a steel.

9. The method of claim 1, further comprising:

applying the adhesive to at least one of a) the other opposing end and b) another recess of another end piece;

affixing the other opposing end in the other recess of the other end piece by setting the adhesive therebetween.

10. The method of claim 1, wherein obtaining the length of the metal rod having the opposing ends comprises machining the at least one end of the metal rod to form the head with the first diameter smaller than the second diameter of the body of the metal rod.

11. The method of claim 1, wherein filling the gap, defined between the proximal end of the at least one end piece and the portion of the metal rod adjacent the proximal end, with the material comprises filling the gap, defined between the proximal end of the at least one end piece and a shoulder of the head to the body of the metal rod, with the material.

12. A sucker rod comprising:

a metal rod having a body with opposing ends;

at least one end piece defining a recess configured to receive at least one of the opposing ends, wherein the at least one end of the metal rod comprises a head with a first diameter smaller than a second diameter of the body of the metal rod, wherein the head is configured to be received within the recess of the end piece;

an adhesive affixing between the recess and the at least one opposing end, the adhesive applied to at least one of a) the at least one opposing end of the metal rod and b) the recess of the at least one end piece; and a material disposed at least partially within a gap defined between a proximal end of the at least one end piece and a portion of the metal rod adjacent the proximal end, the material configured to resist compression.

13. The sucker rod of claim 12, wherein the adhesive is configured to be set by at least one of a) a curing agent, b) setting for a period of time, c) application of heat, and d) application of pressure.

14. The sucker rod of claim 12, wherein the adhesive comprises one of a) a two-part epoxy resin and b) a one-part epoxy resin.

15. The sucker rod of claim 12, further comprises an engagement feature defined in the recess of the at least one end piece and configured to couple with the at least one opposing end of the metal rod.

16. The sucker rod of claim 15, wherein the engagement feature comprises at least one of a) threads, b) teeth, c) ridges, d) grooves, and e) at least one 3-dimensional shape.

17. The sucker rod of claim 12, wherein the material is one of a) a two-part epoxy resin and b) a one-part epoxy resin.

18. The sucker rod of claim 12, further comprising:

another end piece defining another recess configured to receive the other of the opposing ends;

another adhesive affixing between the other recess and the other opposing end.

19. The sucker rod of claim 12, wherein the metal rod comprises a steel.

20. The sucker rod of claim 12, wherein the at least one end of the metal rod comprises a shoulder between the head and the body of the metal rod; and wherein the material is disposed at least partially within the gap defined between the proximal end of the at least one end piece and the shoulder as the portion of the metal rod adjacent the proximal end.

* * * * *